US010290953B2

(12) United States Patent
Lyon et al.

(10) Patent No.: US 10,290,953 B2
(45) Date of Patent: May 14, 2019

(54) ELECTRICAL CONNECTOR

(71) Applicant: PILKINGTON GROUP LIMITED, Lathom, Ormskirk, Lancashire (GB)

(72) Inventors: Michael Lyon, Ormskirk (GB); Julie Houghton, St Helens (GB); Jonathan Mark Williams, Southport (GB); Paul Andrew Skinner, Ashton in Makerfield (GB)

(73) Assignee: PILKINGTON GROUP LIMITED, NR. Ormskirk, Lancashire (GB)

( * ) Notice: Subject to any disclaimer, the term of this patent is extended or adjusted under 35 U.S.C. 154(b) by 0 days.

(21) Appl. No.: 15/751,669

(22) PCT Filed: Aug. 3, 2016

(86) PCT No.: PCT/GB2016/052383
§ 371 (c)(1),
(2) Date: Feb. 9, 2018

(87) PCT Pub. No.: WO2017/025719
PCT Pub. Date: Feb. 16, 2017

(65) Prior Publication Data

US 2018/0233832 A1 Aug. 16, 2018

(30) Foreign Application Priority Data

Aug. 13, 2015 (GB) ..... 1514397.7

(51) Int. Cl.
*H01R 13/40* (2006.01)
*H01R 4/02* (2006.01)
(Continued)

(52) U.S. Cl.
CPC ..... *H01R 4/028* (2013.01); *H01R 4/023* (2013.01); *H01R 43/02* (2013.01); *H01R 11/12* (2013.01);
(Continued)

(58) Field of Classification Search
CPC ..... H01R 4/028; H01R 4/023; H01R 43/02; H01R 11/12; H01R 13/115; H01R 2201/02; H01R 2201/26
(Continued)

(56) References Cited

U.S. PATENT DOCUMENTS 5,411,236 A 5/1995 Morita et al.
2012/0205152 A1 8/2012 Rateiczak et al.
(Continued)

FOREIGN PATENT DOCUMENTS

WO WO 1998/047200 A1 10/1998
WO WO 2014/040773 A1 3/2014
WO WO 2015/067951 A1 5/2015

OTHER PUBLICATIONS

International Search Report (PCT/ISA/210) dated Sep. 28, 2016, by the European Patent Office as the International Searching Authority for International Application No. PCT/GB2016/052383.
(Continued)

*Primary Examiner* — Khiem M Nguyen
(74) *Attorney, Agent, or Firm* — Buchanan Ingersoll & Rooney PC

(57) ABSTRACT

An electrical connector for a glazing comprising a connector portion for connection to an electrical supply, and a button for soldering to a surface of the glazing, the button comprising a base portion adjacent, in use, to the surface of the glazing and an upper portion remote, in use, from the surface of the glazing, wherein the button comprises at least one solder-contacting surface, at least a portion of the solder-contacting surface curving from the base portion to the upper portion and defining a tapering solder cavity. A glazing comprising the electrical connector is also disclosed as is a method of soldering the electrical connector to a glazing.

20 Claims, 8 Drawing Sheets

(51) Int. Cl.
*H01R 43/02* (2006.01)
*H01R 11/12* (2006.01)
*H01R 13/115* (2006.01)

(52) U.S. Cl.
CPC ..... *H01R 13/115* (2013.01); *H01R 2201/02* (2013.01); *H01R 2201/26* (2013.01)

(58) Field of Classification Search
USPC ..... 439/733.1
See application file for complete search history.

(56) References Cited

U.S. PATENT DOCUMENTS

| | | | |
|---|---|---|---|
| 2014/0110166 | A1 | 4/2014 | Degen et al. |
| 2015/0162677 | A1 | 6/2015 | Schmalbuch et al. |
| 2015/0236431 | A1 | 8/2015 | Schmalbuch et al. |

OTHER PUBLICATIONS

Written Opinion (PCT/ISA/237) dated Sep. 28, 2016, by the European Patent Office as the International Searching Authority for International Application No. PCT/GB2016/052383.

Duong et al., Wettability of Lead-Free Solders on Gold-Plated Copper Substrates, *Materials Transactions*, May 25, 2008, pp. 1462-1466, vol. 49, No. 6, The Japan Institute of Metals. https://www.jim.or.jp/journal/e/49/06/1462.html.

ELECTRICAL CONNECTOR

The present invention relates to electrical connectors, to glazings and to methods of soldering electrical connectors to glazings.

It is often necessary to attach electrical connectors on to the surface of glazings to provide electrical power to devices associated with the glazing or to electrically connect devices on the glazing. Such electrical devices may include heaters which need electrical power or antennae which need connection to other devices. Electrical connections to glazings are often used in automotive glazings such as windscreens, rear windows or side windows.

It is known to solder electrical connectors on to the surface of an electrically conductive coating on the surface of a glazing (most often glass). Lead-containing solders have traditionally been used because they have high ductility that can adjust for the mechanical stresses existing between an electrical connector and a glass substrate to which the electrical connector is soldered.

WO-A-98/47200 discloses a terminal stud to be applied to the conductive material on a glass surface.

However, there have been concerns about the use of lead containing solders in general and under European Union Directive 2000/53/EC, lead-containing solders are to be replaced by lead-free solders within the EC.

The use of lead-free solders to attach connectors to glass surfaces can, unfortunately, be problematic because lead-free solder can introduce high mechanical stress in the glass leading to glass cracks and breakage either during the soldering process or subsequently during temperature fluctuations in service.

US-A-2012/0205152 discloses a glass pane with an electrically conductive structure on the glass pane, an adhesive intermediate layer on the electrically conductive structure and at least one electrical connecting element adhered to the intermediate layer. The intermediate layer has hollow spaces adapted to receive electrically conductive masses of lead-free solder, the hollow spaces defining the shape of electrically conductive masses when the connecting elements are attached. The advantage of the disclosure is said to be that because of the adhesive intermediate layer and hollow spaces, mechanical forces that could damage the electrically conductive structure or glass are minimised.

There have been attempts to modify connectors and soldering processes to avoid or reduce such problems.

WO-A-2015/067951 relates to electrical connectors which, when attached to an electrical conductor on a sheet of glazing material by means of a lead-free solder, provide a durable product able to withstand thermal cycling in service.

WO-A-2014/040773 relates to panes with electrical connection elements for vehicles. The connection element is crimped around an electrical connection cable and then soldered on to a conductive layer on the pane. The solder has a maximum outflow between the electrical connection element and electrically conductive structure which may be reduced by movement vertically while the solder is still fluid.

US-A-2015/0162677 relates to a glazing pane having an electrical connection element.

US-A-2014/0110166 discloses a pane with an electrical connection element and a method for its manufacture, whereby critical mechanical stresses in the pane are said to be avoided.

It is an aim of the present invention to address such problems and to provide an electrical connector which mitigates the stress associated with the use of solder, especially lead-free solder.

The present invention accordingly provides, in a first aspect, an electrical connector for a glazing, the electrical connector comprising a connector portion for connection to an electrical supply, and a button for soldering to a surface of the glazing, the button comprising a base portion adjacent, in use, to the surface of the glazing and an upper portion remote, in use, from the surface of the glazing, wherein the button comprises at least one solder-contacting surface, at least a portion of the solder-contacting surface curving from the base portion to the upper portion and defining a tapering solder cavity.

This is greatly advantageous because the curved, tapering solder cavity may act to draw molten solder away from the edges of the button, reducing or preventing solder spreading away from the button and over the surface of the glazing. This results in less stress being applied to the glazing (especially when lead-free solder is used) reducing breakage of parts, in particular, glass.

Thus, preferably, the tapering solder cavity is shaped to draw molten solder into the tapering solder cavity.

More preferably, the tapering solder cavity is shaped so that it acts, during soldering of the electrical connector on the surface of a glazing, to draw molten solder away from the periphery of the connector and into the tapering solder cavity.

In use, the portion of the solder-contacting surface may cooperate with the surface of the glazing to define the tapering solder cavity. In this case, only a single solder contacting surface may be necessary to form the solder cavity. One convenient and useful design is for the solder-contacting surface to be formed in a bell-like shape and hence the solder cavity narrows from the interior of the button toward the edges of the button, or the skirt of the bell-like shape. The solder-contacting surface may therefore be formed in a convex curve. Preferably, the radius of curvature of the convex curve is in the range 2 to 10 mm.

The tapering solder cavity may taper in generally any direction. However, it is preferred if the tapering solder cavity tapers so that the portion of the cavity away from the surface of the glazing is relatively wide and narrows in a direction towards the surface of the glazing. The tapering solder cavity tapers out away from the glazing surface when installed in use (i.e. becomes wider further away from the glazing), so that the tapering solder cavity acts, during soldering of the connector on the surface of a glazing, to draw molten solder away from the periphery of the connector and into the solder cavity, it is thought (without wishing to be bound) by capillary action and thermal expansion. It is therefore preferred if the tapering solder cavity tapers out (i.e. becoming wider) in a direction away from the surface of the glazing.

The connector may comprise a single button. Alternatively, the connector may comprise two buttons, three buttons or more buttons in each case the buttons being electrically connected to each other.

A form of button may be provided wherein a first solder-contacting surface and a second solder-contacting surface cooperate to define the tapering solder cavity. Preferably, the first solder-contacting surface and the second solder-contacting surface are folded portions of the button.

Usually, the electrical connector will comprise metal, preferably at least a portion of the electrical connector is formed of sheet metal.

Use of a sheet metal is convenient especially where the first solder-contacting surface and the second solder-contacting surface cooperate to define the tapering solder cavity because the first solder-contacting surface and the second solder-contacting surface may advantageously be formed of folded metal sheet.

The metal (e.g. sheet metal) may comprise steel, copper, brass, aluminium, or titanium, preferably steel, more preferably carbon steel, for example mild steel. The carbon steel may be low carbon steel with 0.03 to 0.06 wt % carbon (e.g. according to German standard DIN 1624 ST4, equivalent to EN10130 DC04). The carbon steel may be high carbon steel with 0.08 to 0.13 wt % carbon and optionally Mn at 0.3 to 0.6 wt % (e.g. according to US standard SAE-AISI 1010).

The sheet metal preferably has a thermal conductivity in the range 35 to 65 W/m° C., preferably 37 to 60 W/m° C., more preferably 39 to 55 W/m° C. which has great benefits in ensuring that the soldering process is efficient and the heating of the connector is even thereby reducing the chance of hot and/or cold spots.

It is preferred if the sheet metal of the connector has a coefficient of thermal expansion which is close to (i.e. matched) to the coefficient of thermal expansion of the substrate (usually the glass substrate) because thereby mechanical stresses during heating and cooling are reduced. Glass usually has a coefficient of thermal expansion in the range $6\times10^{-6}$/° C. to $10\times10^{-6}$/° C. in a temperature range from 0° C. to 300° C., thus preferably the sheet metal has a thermal expansion coefficient in the range 5 (or 6) to $20\times10^{-6}$/° C., preferably 7 to $18\times10^{-6}$/° C., more preferably 8 to $13\times10^{-6}$/° C.

Preferably, the sheet metal has an electrical conductivity in the range 1 to $9\times10^{6}$ S/m, preferably 2 to $7\times10^{6}$ S/m, more preferably 3 to $7\times10^{6}$ S/m, most preferably 3.4 to $6.7\times10^{6}$ S/m. This provides suitable electrical conductivity to ensure good electrical contact between the power supply of the vehicle (e.g. if used in an automotive glazing) and the electrical components on the glazing It is useful if the connector is provided with solder in the appropriate amount/weight. Thus, preferably the connector further comprises a solder deposit adhered to the connector. Usually, the solder deposit adhered to the connector will be a substantially annular solder deposit.

The solder is preferably a lead-free solder i.e. contains no lead. By no lead is meant having a lead content of 0.1 wt % or lower, preferably 0.05 wt % or lower. This is particularly advantageous because of environment benefits.

Lead-free solders often have lower ductility than lead-containing solders which can lead to high mechanical stresses between a connector and a glass substrate. One of the great advantages of connectors according to the present invention is that mechanical stress is reduced.

The solder may contain one or more of indium, tin, copper, silver, bismuth and zinc. The proportion of tin in the solder may be from 2 wt. % to 99 wt. %, preferably from 10 wt. % to 95 wt. %, more preferably from 15 wt. % to 60 wt. %.

The proportion of bismuth, indium, zinc, copper, silver, in the solder composition may be from 0.5 wt. % to 98 wt. %, preferably 11 wt. % to 68 wt. %. The solder composition may contain nickel, germanium, aluminium, or phosphorus at 0.1 wt. % to 5 wt. %. A preferred solder composition is (in wt %) 96.5 Sn, 3 Ag, 0.5 Cu.

In one version, the upper portion of the button may comprise the connector portion.

In another version, the connector portion may comprise a spade (or other design of) connector portion. The spade connector portion may be a female spade connector portion or a male spade connector portion.

The button may further comprise at least one spacer to space the base portion of the button from the surface of the glazing at a suitable distance to optimise the thickness of solder. The spacer may be an elevation spacer or one or more spacer stubs. The spacer may space the button 0.1 mm to 3 mm from the glazing surface, preferably 0.1 mm to 2 mm, more preferably 0.15 mm to 1.5 mm and most preferably about 0.25 mm.

Preferably, at least a portion of the or each solder-contacting surface comprises a coating comprising copper, nickel, zinc, tin, silver, gold, or alloys or layers thereof to improve wettability of the solder and protect the solder-contacting surface.

It is preferred, in particular if the connector comprises steel, (especially carbon (or mild) steel) that the electrical connector is plated with one layer or two layers. For example, steel may be plated with a single layer of Ni (or Ni/Cu). Alternatively, steel may be plated with two layers, a layer of Ni (or Ni/Cu) on the steel and a layer of Ag on the Ni (or Ni/Cu).

The substrate preferably comprises glass, more preferably float glass. The preferred glass material is soda lime silica glass. Usually, an electrically conductive coating will be present on the glass surface and the connector will be soldered to that electrically conductive coating. The electrically conductive coating may comprise e.g. silver in a glass frit.

Connectors according to the invention are suitable for soldering to a glazing surface even with lead-free solder.

Thus, the present invention provides, in a second aspect, a glazing comprising, a pane of glazing material, an electrically conductive layer on a surface of the pane, a solder deposit on the electrically conductive layer, and an electrical connector on the solder deposit, wherein the electrical connector comprises a connector portion for connection to an electrical supply, and a button comprising a base portion on the solder deposit and an upper portion remote from the surface of the pane, wherein the button comprises at least one solder-contacting surface, at least a portion of the solder-contacting surface curving from the base portion to the upper portion and defining a tapering solder cavity.

The electrically conductive coating on the glazing may have a layer thickness of 5 μm to 40 μm, preferably 5 μm to 20 μm, more preferably, 8 μm to 15 μm and, most preferably 10 μm to 12 μm. The electrically conductive coating will usually comprise silver, preferably, silver particles and a glass frit.

The layer thickness of the solder will usually be less than 1 mm, preferably 0.7 mm or lower, more preferably 0.5 mm or lower and most preferably 0.3 mm or lower.

After soldering, usually a fillet of solder will extend into the solder cavity.

It is preferred if the solder comprises lead-free solder generally as described in relation to the first aspect.

Preferably, the solder, electrically conductive layer and solder-contacting surface of the connector are adapted so that the solder wets the electrically conductive layer and/or the solder-contacting surface. More preferably the solder wets the electrically conductive layer and/or the solder-contacting surface such that the solder contact angle is 90° or below, even more preferably 80° or below most preferably 75° or below, on the electrically conductive layer and/or on the solder-contacting surface.

Good wetting of the electrically conductive layer or the solder-contacting surface, advantageously both electrically conductive layer and the solder-contacting surface, tends to reduce stress on the glass. Solder contact angle may be measured as is known to those skilled in the art by measuring the angle at the edge of a drop or mass of solder on a surface (an example of the method is as indicated in Duong et al. *Mater. Trans.* 49 (2008) p. 1462)

In a third aspect, the present invention provides a method of soldering an electrical connector to a glazing, the method comprising, providing a pane of glazing material with an electrically conductive layer on a surface of the pane, providing a solder deposit on the electrically conductive layer, providing an electrical connector on the solder deposit, wherein the electrical connector comprises a connector portion for connection to an electrical supply, and a button comprising a base portion on the solder deposit and an upper portion remote from the surface of the pane, wherein the button comprises at least one solder-contacting surface, at least a portion of the solder-contacting surface curving from the base portion to the upper portion and defining a tapering solder cavity, and fusing the solder.

In the aspects of the invention (especially the second or third aspects), preferably the substrate or pane of glazing material comprises glass. The pane of glazing material may be a single glass sheet or may comprise laminated glass. The laminated glass may comprise a first ply of glass, a ply of interlayer material (preferably of polyvinyl butyral, PVB) and a second ply of glass and the electrically conductive layer is preferably on a surface of the first and/or the second glass ply.

The glazing is preferably a vehicle glazing. The glazing may be a windscreen, rear window or other window of a car or other vehicle, or a glazing of a commercial vehicle, locomotive or aircraft, or a boat or ship.

The present invention will now be described by way of example only, and with reference to, the accompanying drawings, in which.

In the Figures, the same reference numbers refer to the same or to corresponding features.

Figure 1:
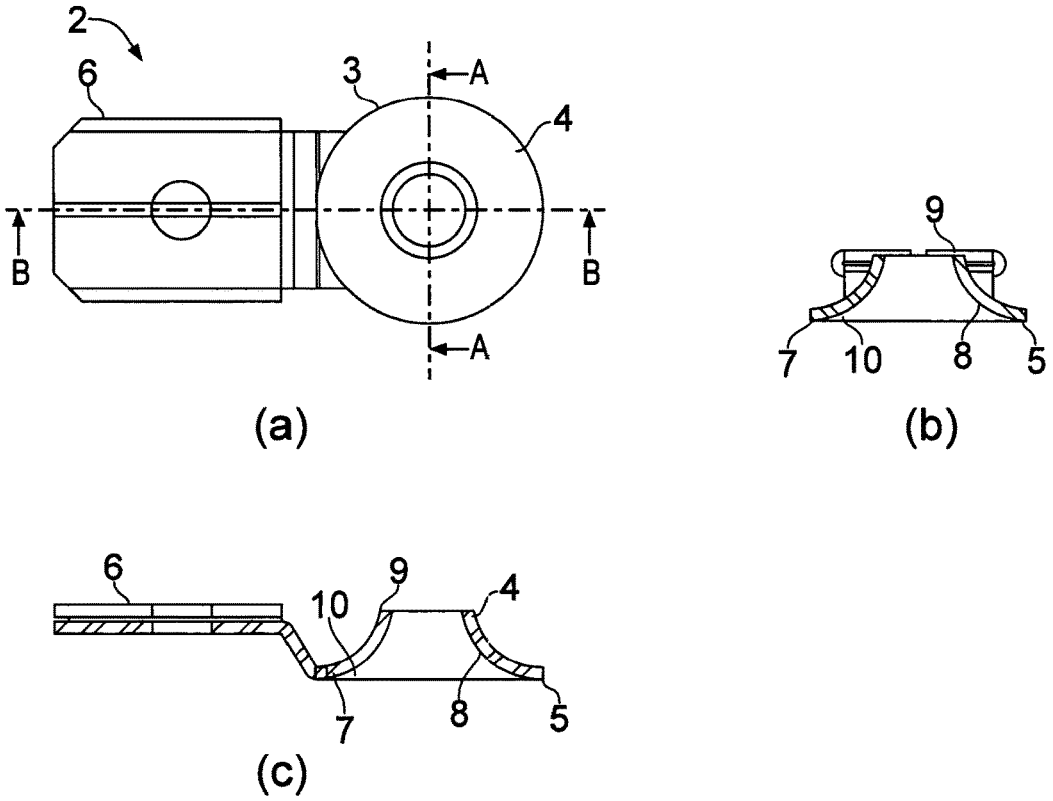
FIG. 1 illustrates a first connector according to the invention in (a) plan view, (b) in sectional view on A-A of (a), and (c) in sectional view on B-B of (a)

FIG. 1 shows a first type of a connector 2 according to the present invention. The connector 2 comprises two main parts, a button 4 intended to be soldered on to the surface of a glazing (not shown, see FIG. 10) and a connector portion 6 in the form of a female spade connector, for connection to a cable (not shown) and hence to a device and/or a power supply. The connector 2 is formed of sheet metal, usually sheet steel (preferably mild steel because of its advantageous properties including coefficient of thermal expansion) or sheet copper or brass because of the beneficial wetting properties of these metals with solder. The solder contacting surfaces of the connector 2 are preferably plated with e.g. Cu, Ni, Ag in order to improve solder wetting of the surface still further. Usually, especially if the metal is steel, the metal will be plated with a single layer of Ni (or Ni/Cu), or with two layers: a layer of Ni (or Ni/Cu) on the steel and a layer of Ag on the Ni (or Ni/Cu).

A section through the button 4 on A-A of FIG. 1(*a*) is shown in FIG. 1(*b*) and a section through B-B of FIG. 1(*a*) is shown in FIG. 1(*c*). As can be seen in FIGS. 1(*b*) and 1(*c*), the button 4 in cross section is in the shape of a truncated bell, with the skirt portion 7 of the button curving from the base portion 5 to the upper portion 9. The inner surface of the skirt portion 7 forms a solder-contacting surface 8 and, because of the curvature of the skirt portion 7, when the button 4 is on the surface of a glazing, the solder-contacting surface 8 defines a tapering solder cavity 10. The tapering solder cavity 10 acts, during soldering of the button on the surface of a glazing, because it tapers out away from the glazings (i.e. becomes wider further away from the glazing and more towards the centre of the button 4), to draw molten solder away from the periphery 3 of the button 4 and into the solder cavity 10. This, surprisingly, has the effect of significantly reducing the stress induced on the glazing during the soldering process reducing the chance of part (in particular, glass) breakage. It is thought that because of the taper of the solder cavity 10, and especially its curved taper, capillary action and thermal expansion of the molten solder both act to draw the molten solder into the solder cavity 10.

Figure 2:
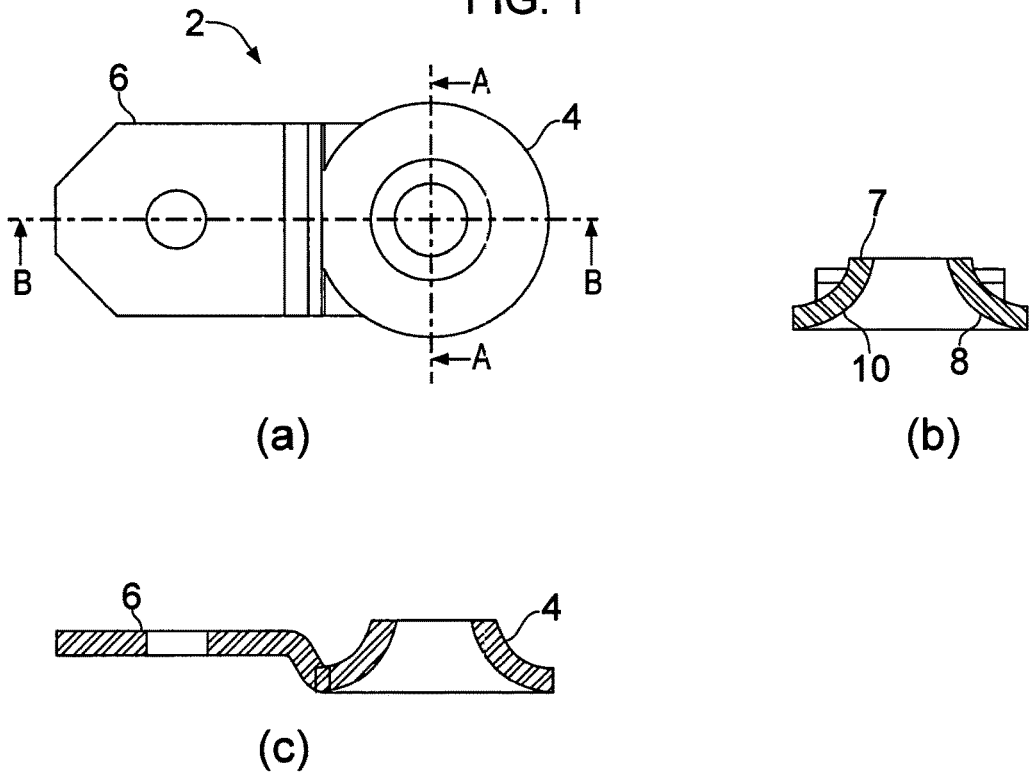
FIG. 2 illustrates a second connector according to the invention in (a) plan view, (b) in sectional view on A-A of (a), and (c) in sectional view on B-B of (a)

FIG. 2 shows a second type of connector according to the invention. The connector 2 in FIG. 2 is of generally similar form to the connector 2 of FIG. 1 and will not be described in detail. The connector portion 6 in the form of a spade connector of FIG. 2 is generally wider in relation to the button 4 to accommodate different cables to those suitable for connection to the connector 2 of FIG. 1. The skirt portion 7 of the button 4 of the connector 2 shown in FIG. 2 is formed of thicker sheet metal to modify the thermal and strength properties of the button 4.

Figure 3:
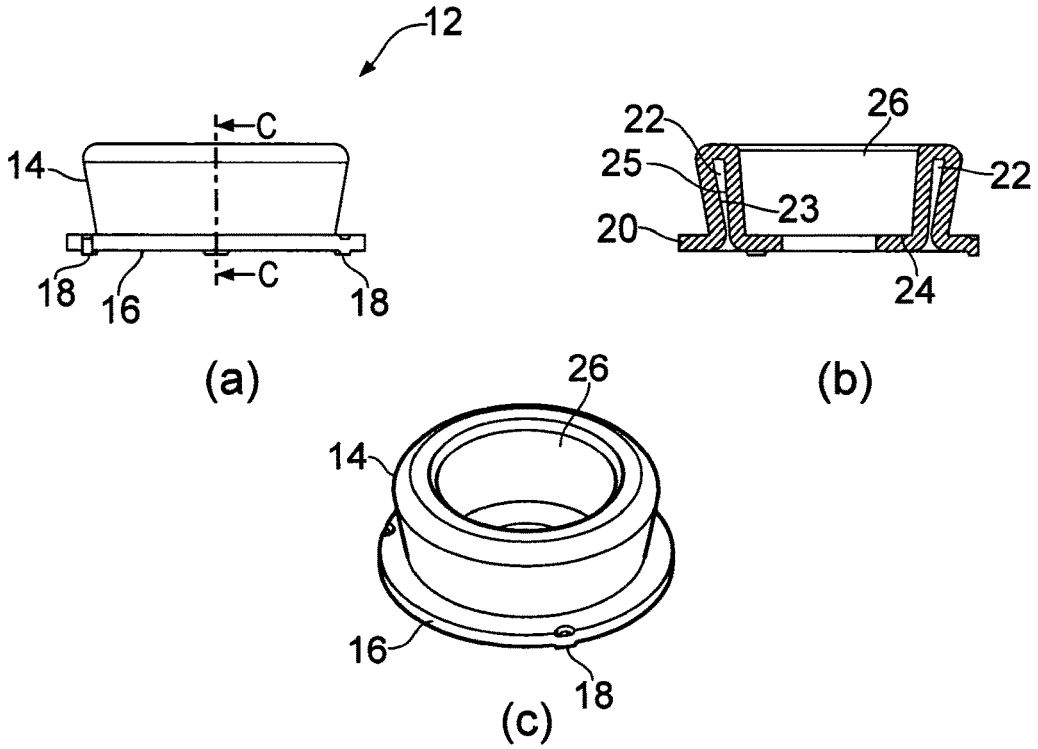
FIG. 3 illustrates a third connector according to the invention in (a) side view, (b) in sectional view on C-C of (a), and (c) in perspective view.

FIG. 3 shows a third type of a connector 12 according to the present invention. The connector 12 is of a different form to the connectors of FIGS. 1 and 2. The connector 12 comprises a button 14 intended to be soldered to the surface of a glazing (not shown). The connector 12 is of generally cylindrical form. The inside of the connector 12 forms a hollow portion 26 which may act as a connection portion by insertion of a cable connector of suitable form into the hollow portion 26. After insertion of such a cable connector the hollow portion 26 may retain the cable connector by interference and/or resilience (e.g. a snap-action connector), by adhesive or may be crimped or soldered to fix the cable connector in position. The connector 12 has a base plate 16 and protruding from the base plate 16 there are three spacers 18 which act, when the connector is on the surface of a glazing, to space the button 14 an appropriate distance above the glazing surface to enable solder to flow under the button consistently and evenly. The spacers 18 may space the button 14 a distance of from 0.1 mm to 2 mm above the glazing surface, preferably about 0.25 mm above the glazing surface.

The connector 12 is formed of sheet metal, usually sheet steel (preferably mild steel because of its advantageous coefficient of thermal expansion) or sheet copper because of the beneficial wetting properties of these metals with solder. The solder contacting surfaces of the connector 12 are preferably plated with e.g. Cu, Ni, Ag in order to improve solder wetting of the surface still further.

A section through the button 14 on C-C of FIG. 3(*a*) is shown in FIG. 3(*b*). As can be seen in FIG. 3(*b*), the button 14 in cross section is seen to be formed of the sheet metal curved and folded to form a first sheet portion 20 and a second sheet portion 24 and an annular tapering solder cavity 22 between the first sheet portion 20 and a second sheet portion 24. The solder cavity 22 is narrow towards the base plate 16 of the button 14, and tapers outwards in the direction away from the base plate 16. The inner surfaces of the first sheet portion 20 and a second sheet portion 24 in the solder cavity 22 form a first solder-contacting surface 23 and a second solder contacting surface 25 respectively. The tapering solder cavity 22 acts during soldering of the button 14 on to the surface of a glazing, because it tapers out away from the glazings (i.e. becomes wider further away from the glazing), to draw molten solder away from the periphery of the base plate 16 and into the solder cavity 22. This, surprisingly, has the effect of significantly reducing the stress induced on the glazing during the soldering process reducing the chance of part (in particular, glass) breakage. It is thought that because of the taper of the solder cavity 22, and especially the curving first solder contacting surface 23 and second solder contacting surface 25 where the sheet metal is folded, capillary action and thermal expansion of the molten solder both act to draw the molten solder into the solder cavity 22.

FIG. 3(*c*) shows a perspective view of the connector 12 showing the button 14, hollow portion 26, base plate 16 and spacer 18.

Figure 4:
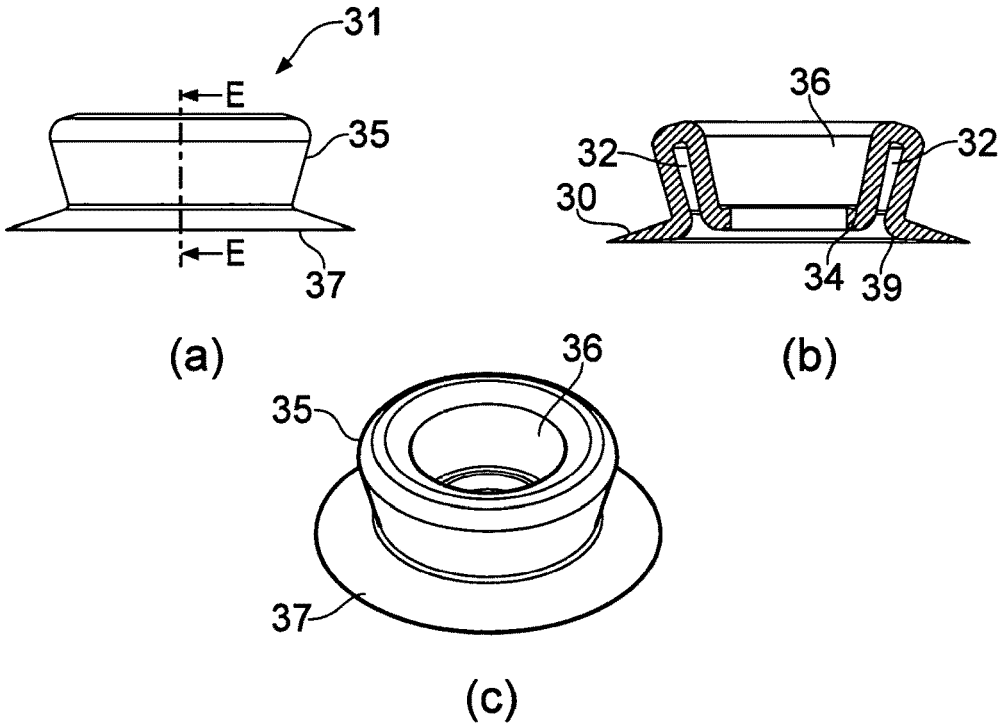
FIG. 4 illustrates a fourth connector according to the invention in (a) side view, (b) in sectional view on E-E of (a), and (c) in perspective view.

FIG. 4 shows a connector 31 of generally similar form to the connector 12 of FIG. 3 and similar parts will not be described in detail. The connector 31 comprises a button 35 with a hollow portion 36 and a base portion 37. The connector 31 differs from connector 12 of FIG. 3 in that the base portion 37 of FIG. 4 extends outwardly from the circumference of the button 35 and is designed to contact the glazing surface. As seen in FIG. 4(*b*), which is a section on E-E of FIG. 4(*a*), the base portion acts as a skirt with the outer part of the skirt intended to sit flush on the glazing surface and acting as an elevation spacer 39 to provide a recess inside the skirt for solder to contact the button 35. As in FIG. 3, the connector 31 is formed of a curved, folded metal sheet, forming a first sheet portion 30 and a second sheet portion 34 defining an annular solder cavity 32.

FIG. 4(*c*) shows a perspective view of the connector 31 showing the button 35, hollow portion 36, and base portion 16.

Figure 5:
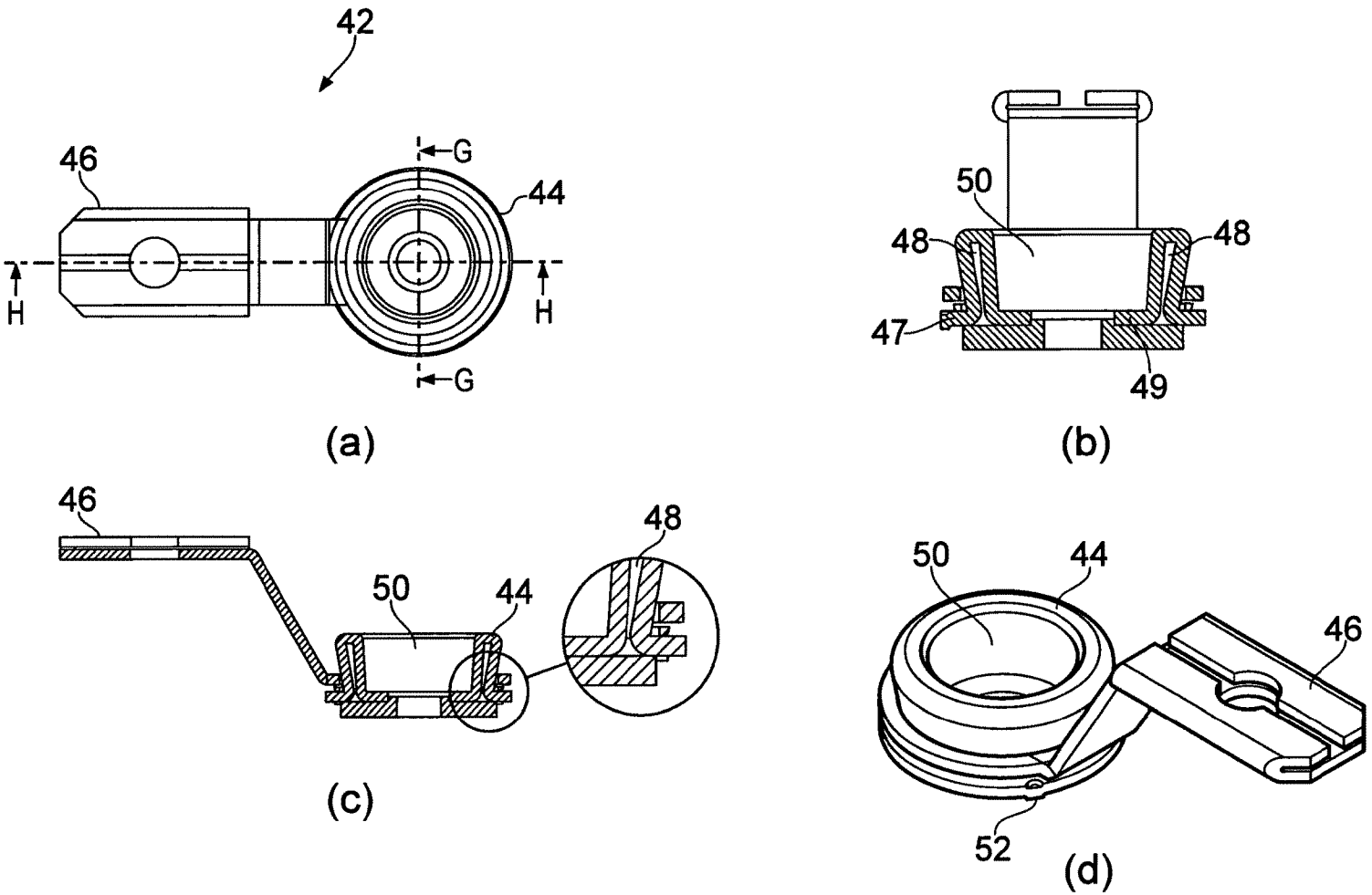
FIG. 5 illustrates a fifth connector according to the invention in (a) plan view, (b) in sectional view on G-G of (a), (c) in sectional view on H-H of (a), and (d) in perspective view.
Figure 6:
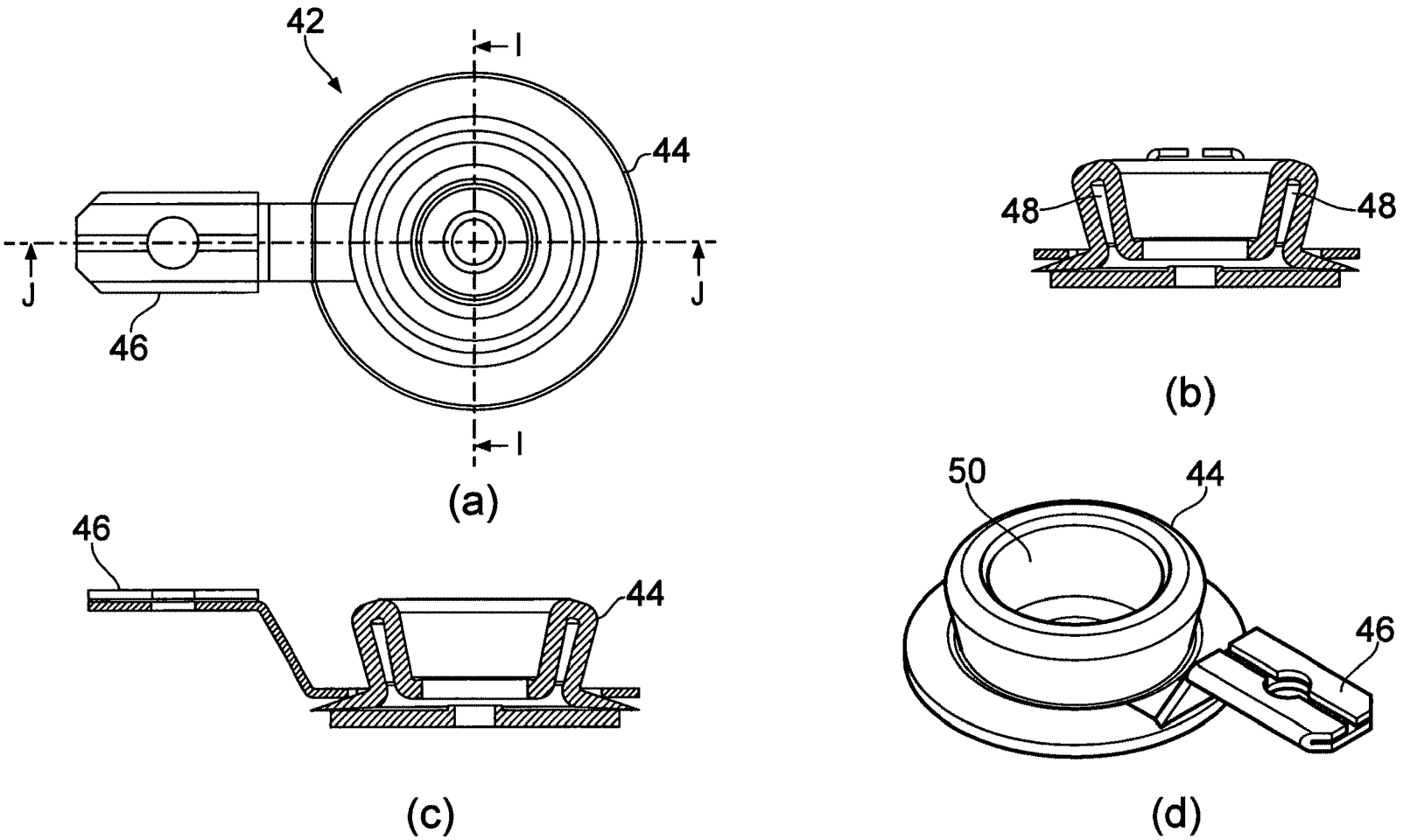
FIG. 6 illustrates a sixth connector according to the invention in (a) plan view, (b) in sectional view on I-I of (a), (c) in sectional view on J-J of (a), and (d) in perspective view.
Figure 7:
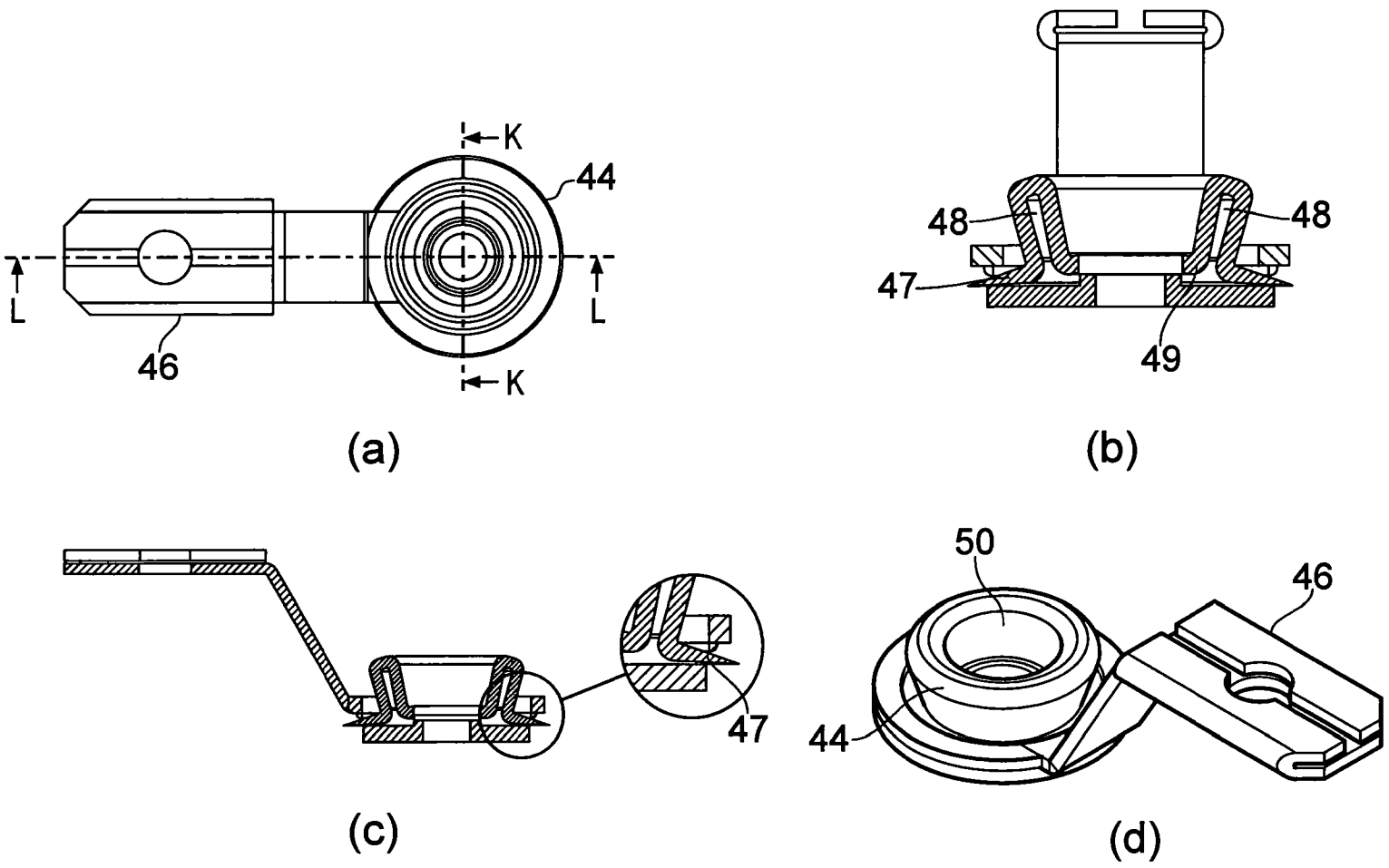
FIG. 7 illustrates a seventh connector according to the invention in (a) plan view, (b) in sectional view on K-K of (a), (c) in sectional view on L-L of (a), and (d) in perspective view.
Figure 8:
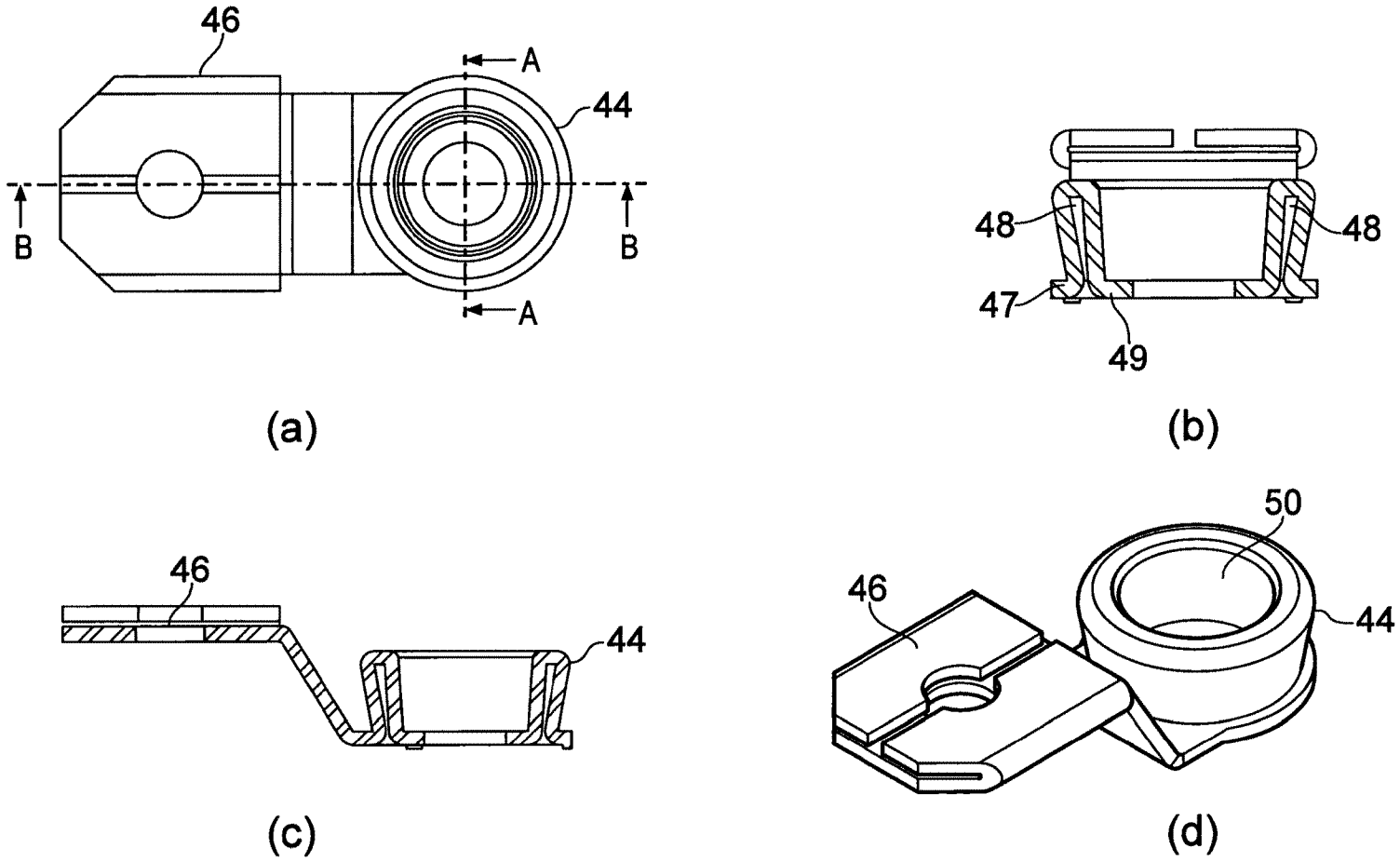
FIG. 8 illustrates an eighth connector according to the invention in (a) plan view, (b) in sectional view on A-A of (a), (c) in sectional view on B-B of (a), and (d) in perspective view.
Figure 9:
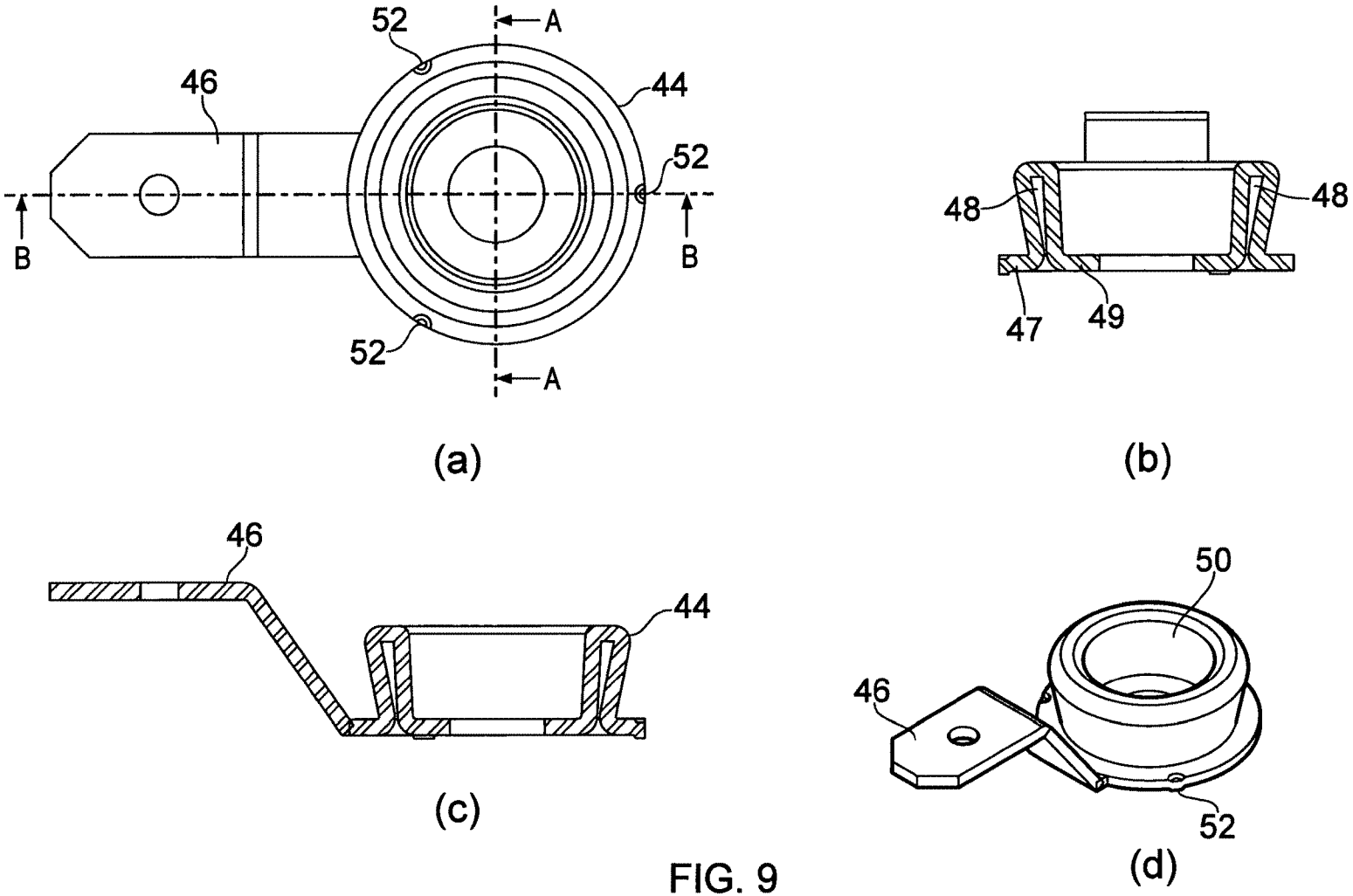
FIG. 9 illustrates a ninth connector according to the invention in (a) plan view, (b) in sectional view on A-A of (a), (c) in sectional view on B-B of (a), and (d) in perspective view.

FIG. 5 shows a fourth type of a connector 42 according to the present invention. The connector 42 is of a folded type generally as shown in FIGS. 3 and 4, but in this case comprises a button 44 intended to be soldered to a glazing surface (not shown, see FIG. 10) and a connector portion 46 in the form of a female spade connector, for connection to a cable (not shown) and hence a device and/or power supply. The connector 42 is formed of sheet metal, usually sheet steel (preferably mild steel because of its advantageous coefficient of thermal expansion) or sheet copper because of the beneficial wetting properties of these metals with solder. The solder contacting surfaces of the connector 42 are preferably plated with e.g. Cu, Ni, Ag in order to improve solder wetting of the surface still further. A section through the button 44 on G-G of FIG. 5(*a*) is shown in FIG. 5(*b*). As can be seen in FIG. 5(*b*), the button 44 in cross section is of generally cylindrical form and is formed of sheet metal, curved and folded to form a first sheet portion 47 and a second sheet portion 49 and an annular tapering solder cavity 48 between the first sheet portion 47 and a second sheet portion 49. The solder cavity 48 is narrow towards the base of the button 44, and tapers outwards (thus, widening) in the direction away from the base. The inner surfaces of the first sheet portion 47 the second sheet portion 49 in the solder cavity 48 form a first and second solder-contacting surface respectively. The tapering solder cavity 48 acts, during soldering of the button 44 on to the surface of a glazing to draw molten solder away from the periphery of the button 44 and into the solder cavity 48. This, surprisingly, has the effect of significantly reducing the stress induced on the glazing during the soldering process reducing the chance of part, especially glass, breakage. It is thought that because of the taper of the solder cavity 48, and especially the curving first and solder contacting surfaces where the sheet metal is folded, capillary action and thermal expansion of the molten solder both act to draw the molten solder into the solder cavity 48.

FIG. 5(*d*) shows a perspective view of the connector 42 showing the button 44, hollow portion 50, connector portion 46 and one of the three spacers 52 protruding from the base of the button 44 which act, when the button 44 is on the surface of a glazing, to space the button 44 an appropriate distance above the glazing surface to enable solder to flow under the button consistently and evenly. The spacers 52 may space the button 44 from 0.1 mm to 2 mm above the glazing surface, preferably about 0.25 mm above the glazing surface.

FIGS. 6, 7, 8 and 9 show respectively sixth, seventh, eighth, and ninth types of connectors according to the invention. The connectors in FIGS. 6 to 9 are generally similar in form to the connector 42 of FIG. 5 and will not be described in detail. In the connectors 42 of FIGS. 6 to 10, the relative size of the buttons 44 and connector portions 46 varies and, in FIG. 9, the connector portion 46 is in the form of a male spade connector.

Figure 10:
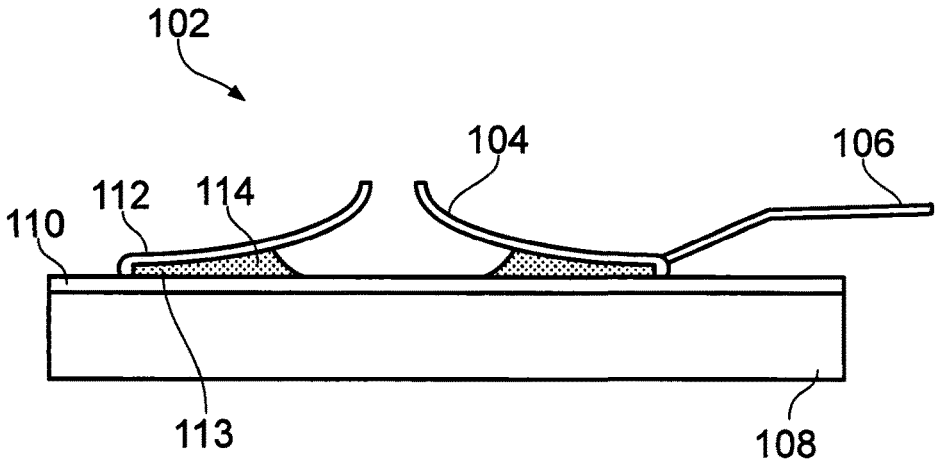
FIG. 10 is a schematic sectional side view of a connector soldered to a glazing according to the invention.

FIG. 10 illustrates schematically a connector 102 according to the invention, soldered on to a glazing surface. The connector 102 comprises a button portion 104 and a spade connector 106. The button portion 104 is soldered on to the electrically conductive coating 110 (usually comprising silver particles in a glass frit) adhered to the surface of a glass substrate 108. The glass substrate 108 may be a single sheet of glass. Alternatively, the glass substrate 108 may be a laminated glass substrate comprising a first glass ply, an interlayer material (preferably of polyvinyl butyral, PVB) and a second glass ply. The surface to which the electrically conductive coating 110 is adhered is preferably the surface of the first glass ply or second glass ply. Because of the curved solder contacting portion 112 of the button portion 104, solder, when molten, is drawn (it is thought, without wishing to be bound, by capillary action and/or thermal expansion) into the solder cavity 113 defined by the solder contacting portion 112 and electrically conductive coating 110 surface. When solidified, the solder forms a solder fillet 114 in the solder cavity 113.

Figure 11:
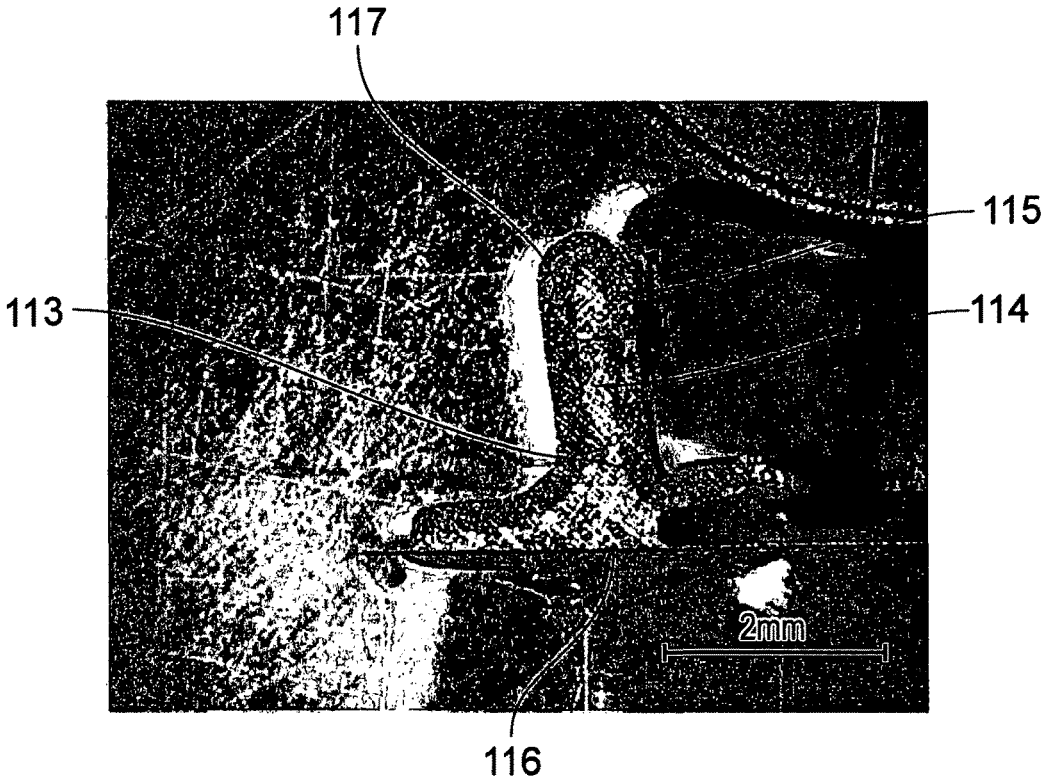
FIG. 11 is a photograph of a section through a portion of a connector according to the invention after soldering to a substrate.

FIG. 11 is a photograph of a section through the button part of a connector on a substrate 116, the connector being generally as illustrated in FIGS. 3 to 9. The photograph shows the connector after soldering with folded first sheet portion 117 and second sheet portion 115 defining a tapering solder cavity 113 containing a solder fillet 114 which was drawn up as molten solder into the solder cavity 113 by capillary action and/or thermal expansion during soldering.

REFERENCE NUMERALS

2 connector
3 periphery of button
4 button
5 base portion of button
6 connector portion
7 skirt portion
8 solder-contacting surface
9 upper portion of button
10 tapering solder cavity
12 connector
14 button
16 base plate
18 spacer
20 first sheet portion
22 solder cavity
23 first solder contacting surface
24 second sheet portion
25 second solder contacting surface
26 hollow portion
30 first sheet portion
31 connector
32 solder cavity
34 second sheet portion
35 button
36 hollow portion
37 base portion
39 elevation spacer
42 connector
44 button
46 connection portion
47 first sheet portion
48 solder cavity
49 second sheet portion
50 hollow portion
52 spacer
102 connector
104 button portion
106 spade connector
108 glass substrate
110 electrically conductive coating
112 solder contacting portion
113 solder cavity
114 solder fillet
115 second sheet portion
116 substrate
117 first sheet portion

The invention claimed is:

1. An electrical connector for a glazing, the electrical connector comprising, a connector portion for connection to an electrical supply, and a button for soldering to a surface of the glazing, the button comprising a base portion adjacent, in use, to the surface of the glazing and an upper portion remote, in use, from the surface of the glazing, wherein the button comprises at least one solder-contacting surface, at least a portion of the solder-contacting surface curving from the base portion to the upper portion and defining a tapering solder cavity.

2. An electrical connector as claimed in claim 1, wherein the tapering solder cavity is shaped to draw molten solder into the tapering solder cavity.

3. An electrical connector as claimed in claim 1, wherein, in use, the portion of the solder-contacting surface cooperates with the surface of the glazing to define the tapering solder cavity.

4. An electrical connector as claimed in claim 1, wherein a first solder-contacting surface and a second solder-contacting surface cooperate to define the tapering solder cavity.

5. An electrical connector as claimed in claim 1, wherein the tapering solder cavity tapers out in a direction away from the surface of the glazing, in use.

6. An electrical connector as claimed in claim 1, wherein the electrical connector comprises steel, nickel, copper, brass, aluminium, or titanium.

7. An electrical connector as claimed in claim 1, further comprising a solder deposit adhered to the connector.

8. An electrical connector as claimed in claim 7, wherein the solder deposit is a substantially annular solder deposit.

9. An electrical connector as claimed in claim 1, wherein the connector portion comprises a spade connector portion.

10. An electrical connector as claimed in claim 1, wherein the button further comprises at least one spacer to space the base portion of the button from the surface of the glazing.

11. An electrical connector as claimed in claim 1, wherein at least a portion of the or each solder-contacting surface comprises a coating comprising copper, nickel, zinc, tin, silver, gold, or alloys or layers thereof.

12. A glazing comprising, a pane of glazing material, an electrically conductive layer on a surface of the pane, a solder deposit on the electrically conductive layer, and an electrical connector comprising at least one solder-contacting surface as claimed in claim 1 on the solder deposit.

13. A glazing as claimed in claim 12, wherein a fillet of solder extends into the solder cavity.

14. A glazing as claimed in claim 12, wherein the solder comprises lead-free solder.

15. A glazing as claimed in claim 12, wherein the solder wets the electrically conductive layer and/or the solder-contacting surface.

16. A glazing as claimed in claim 12, wherein the pane of glazing material comprises glass.

17. A glazing as claimed in claim 12, wherein the pane of glazing material comprises laminated glass.

18. A glazing as claimed in claim 17, wherein the laminated glass comprises a first ply of glass, a ply of interlayer material and a second ply of glass and the electrically conductive layer is on a surface of the first and/or the second glass ply.

19. A glazing as claimed in claim 12, wherein the glazing is a vehicle glazing.

20. A method of soldering an electrical connector to a glazing, the method comprising, providing a pane of glazing material with an electrically conductive layer on a surface of the pane, providing a solder deposit on the electrically conductive layer, providing an electrical connector as claimed in claim 1 on the solder deposit, and fusing the solder.

* * * * *